US006390810B1

(12) United States Patent
Rinker et al.

(10) Patent No.: US 6,390,810 B1
(45) Date of Patent: May 21, 2002

(54) METHOD AND APPARATUS FOR REDUCING A FEED MATERIAL IN A ROTARY HEARTH FURNACE

(75) Inventors: Franklin G. Rinker, Naples, FL (US); Deane A. Horne, Toledo; James Alan Thornton, Maumee, both of OH (US)

(73) Assignee: Maumee Research & Engineering, Inc., Northwood, OH (US)

( * ) Notice: Subject to any disclaimer, the term of this patent is extended or adjusted under 35 U.S.C. 154(b) by 0 days.

(21) Appl. No.: 09/763,537

(22) PCT Filed: Mar. 15, 1999

(86) PCT No.: PCT/US99/05671

§ 371 Date: Feb. 21, 2001

§ 102(e) Date: Feb. 21, 2001

(87) PCT Pub. No.: WO00/55559

PCT Pub. Date: Sep. 21, 2000

(51) Int. Cl.[7] ..... F27B 15/02; F27B 9/16

(52) U.S. Cl. ..... 432/138; 75/474; 75/477; 432/27

(58) Field of Search ..... 432/27, 135, 138, 432/139, 140; 110/233, 347; 266/173; 75/474, 477, 487

(56) References Cited

U.S. PATENT DOCUMENTS

| | | | | |
|---|---|---|---|---|
| 3,836,320 A | | 9/1974 | Hemsath et al. | |
| 4,245,821 A | | 1/1981 | Kappell et al. | |
| 4,266,967 A | * | 5/1981 | Yamada et al. | 432/18 |
| 4,406,618 A | | 9/1983 | Maeyama | |
| 4,412,813 A | | 11/1983 | Wulf | |
| 4,431,406 A | | 2/1984 | Weiss | |
| 4,496,312 A | * | 1/1985 | Yamada et al. | 432/138 |
| 4,597,564 A | | 7/1986 | Hanewald et al. | |
| 4,622,905 A | | 11/1986 | MacDougall et al. | |
| 4,636,127 A | | 1/1987 | Olano et al. | |
| 4,818,222 A | | 4/1989 | Docherty et al. | |
| 4,870,912 A | | 10/1989 | Lee | |
| 5,180,423 A | | 1/1993 | Marcuson et al. | |
| 5,567,224 A | | 10/1996 | Kundrat | |
| 5,632,616 A | | 5/1997 | Tutt et al. | |
| 5,730,775 A | | 3/1998 | Meissner et al. | |
| 5,853,657 A | | 12/1998 | Diaz et al. | |
| 5,899,688 A | * | 5/1999 | Fontana | 432/139 |
| 5,989,019 A | * | 11/1999 | Nishimura et al. | 432/138 |

* cited by examiner

*Primary Examiner*—Gregory Wilson
(74) *Attorney, Agent, or Firm*—MacMillan, Sobanski & Todd, LLC

(57) ABSTRACT

A rotary hearth furnace for reducing a feed material is disclosed. The rotary hearth furnace includes a rotating hearth disposed in an enclosure and mounted for rotary movement. The enclosure includes an annular inner wall, an annular outer wall and a roof. The enclosure is sealed to the hearth and divided into a plurality of zones including at least a loading zone, a process zone and a discharge zone. The furnace further includes a plurality of burners positioned in at least the outer wall of the enclosure to provide a controlled temperature within the rotary hearth furnace and a flue positioned within the reduction zone of the furnace between the preheat zone and the discharge zone to exhaust combustion gases from the burners and gases resulting from the processing of the feed material. Said flue contains space for combustion and settling of the unburned particulates. A water spray quench reduces the temperature of the furnace off-gas so that subsequent combustion by the introduction of air or oxygen does not produce significant nitrogen oxides.

23 Claims, 2 Drawing Sheets

METHOD AND APPARATUS FOR REDUCING A FEED MATERIAL IN A ROTARY HEARTH FURNACE

FIELD OF THE INVENTION

This invention relates to a rotary hearth furnace and a process of reducing a feed material in a rotary hearth furnace. More particularly, this invention relates to a rotary hearth furnace having an improved flue system and a process of reducing a feed material in a rotary hearth furnace.

BACKGROUND OF THE INVENTION

A typical rotary hearth furnace includes an annular inner refractory wall, an annular outer refractory wall and an annular hearth disposed between the inner and outer walls. The hearth is movably supported on an array of rollers about its circumference. Disposed between the inner and outer walls and above the hearth is a stationary roof. A plurality of burners are positioned along the inner and/or outer walls and fire into the annular space above the rotating hearth within the stationary roof to heat a feed material that is typically conveyed on the rotating hearth through various zones, e.g., loading zone, process zone and discharge zone.

In operation, the feed material to be heated is placed directly on the hearth in the loading zone and then conveyed through the process zone wherein the feed material is subjected to radiant heating and process gases conducive to chemical reaction as the feed material is conveyed around the hearth path. The processed feed material is then removed from the rotating hearth in the discharge zone.

In a rotary hearth furnace, such as shown in U.S. Pat. Nos. 4,597,564 and 4,622,905, incorporated herein by reference in their entirety, gases that are produced in the rotary hearth furnace are exhausted from a flue positioned adjacent the loading zone and away from the discharge zone of the furnace. The flue is positioned adjacent the loading zone and away from the discharge zone of the furnace to create a counter flow system drawing gases from the discharge zone to the loading zone, i.e., the effluent flows counter to the direction of rotation of the hearth for maximum exposure time to the feed material to be heated. Although the flue systems have performed satisfactorily, it has been found that the gases produced in a typical counter flow type rotary hearth furnace near the discharge zone tend to short circuit the intended gas flow through the water seal tunnel and flow directly to the flue, thereby avoiding the process zone and the loading zone. Furthermore, it will also be appreciated that when the flue is positioned adjacent or proximate either the loading zone or the discharge zone a pressure differential is obtained at the loading zone and the discharge zone conducive to the escape of the furnace gases from the rotary hearth furnace through the loading zone and the discharge zone.

Furthermore, in the direct reduction of iron process, a high $CO/CO_2$ ratio in the last zone of the furnace is required to prevent back oxidation of the direct reduced iron (DRI). It will be appreciated that to maintain high $CO/CO_2$, ratios, the burners must be operated & relatively low air to fuel ratios (less than 6.2 to 1). These low air to fuel ratios translate to unacceptably low available heat values. i.e., 84.5 $BTU/ft^3$ of natural gas at an air/fuel ratio of 6.12, which translates into high fuel usage. Three countermeasures are available to improve the available heat problem. The first is to recover energy from the furnace exhaust gases to preheat combustion air, the second is to replace some or all of the combustion air with oxygen, and the third is to combine preheated combustion air with oxygen enrichment. Table 1 summarizes the effect of preheating combustion air and oxygen enrichment on the available heat, and on the pounds of natural gas consumed per pound of direct reduced iron (DRI) produced.

TABLE 1

Available Heat and Oxygen Enrichment at $CO/CO_2$ ratio of about 2

| Percent Oxygen | Preheat Temperature Degrees F | Air/Fuel Ratio Volume/Volume | Available Heat $BTU/ft_3$ fuel | Natural Gas lbs/lb Direct Reduced Iron |
|---|---|---|---|---|
| 21 | 70 | 6.12 | 84 | |
| 21 | 1000 | 6.12 | 193 | 0.118 |
| 21 | 1200 | 6.12 | 218 | 0.106 |
| 21 | 1400 | 6.12 | 243 | 0.096 |
| 25 | 1000 | 5.12 | 221 | 0.107 |
| 25 | 1200 | 5.12 | 242 | 0.098 |
| 25 | 1400 | 5.12 | 263 | 0.090 |
| 30 | 1000 | 4.27 | 248 | 0.098 |
| 30 | 1200 | 4.27 | 265 | 0.092 |
| 30 | 1400 | 4.27 | 283 | 0.086 |

In view of the foregoing, it will be appreciated that there is a significant need for an improved rotary hearth furnace that is directed to problems of the prior art. It is an object of the present invention to provide a rotary hearth furnace having improved process gas flow. It is another object of the present invention to provide a rotary hearth furnace that prevents the process gas from short circuiting the process zone through either the loading zone and/or the discharge zone of the furnace. Another object of the present invention is to provide a rotary hearth furnace that efficiently utilizes the available energy to reduce the feed material in a rotary hearth furnace. Yet another object of the present invention is to provide a rotary hearth furnace that efficiently reduces the amount of stack gases exiting the flue of a rotary hearth furnace such that the size of the exhaust equipment may be reduced. Another object of the present invention is to provide a draft away from the loading zone to eliminate release of potentially toxic vapors arising from the organic or carbonaceous binders used in preparation of the feed material through the slots of the feeder. It will be appreciated that this allows the process gas to be combined with oxygen from air and to burn thereby releasing heat within the preheat zone of the furnace. Yet another object of the present invention is to provide a rotary hearth furnace that is simple and economical to manufacture.

SUMMARY OF THE INVENTION

Briefly, according to this invention there is provided a rotary hearth furnace for reducing a feed material. The rotary hearth furnace includes a rotating hearth disposed in a refractory lined enclosure and mounted for rotary movement. The enclosure includes an annular inner wall, an annular outer wall and a roof. The enclosure is operatively sealed to the hearth and divided into a plurality of zones including at least a loading zone, a preheat zone, a process zone and a discharge zone. The furnace further includes a plurality of burners positioned in at least the outer wall of the enclosure to provide a controlled temperature within the rotary hearth furnace and a flue positioned between the preheat zone and the process zone of the furnace to exhaust combustion gases from the burners and process gases resulting from the processing of the feed material.

DESCRIPTION OF THE DRAWINGS

Further features and other objects and advantages of this invention will become clear from the following detailed description made with reference to the drawings in which.

DETAILED DESCRIPTION OF THE PREFERRED EMBODIMENTS

Figure 1:
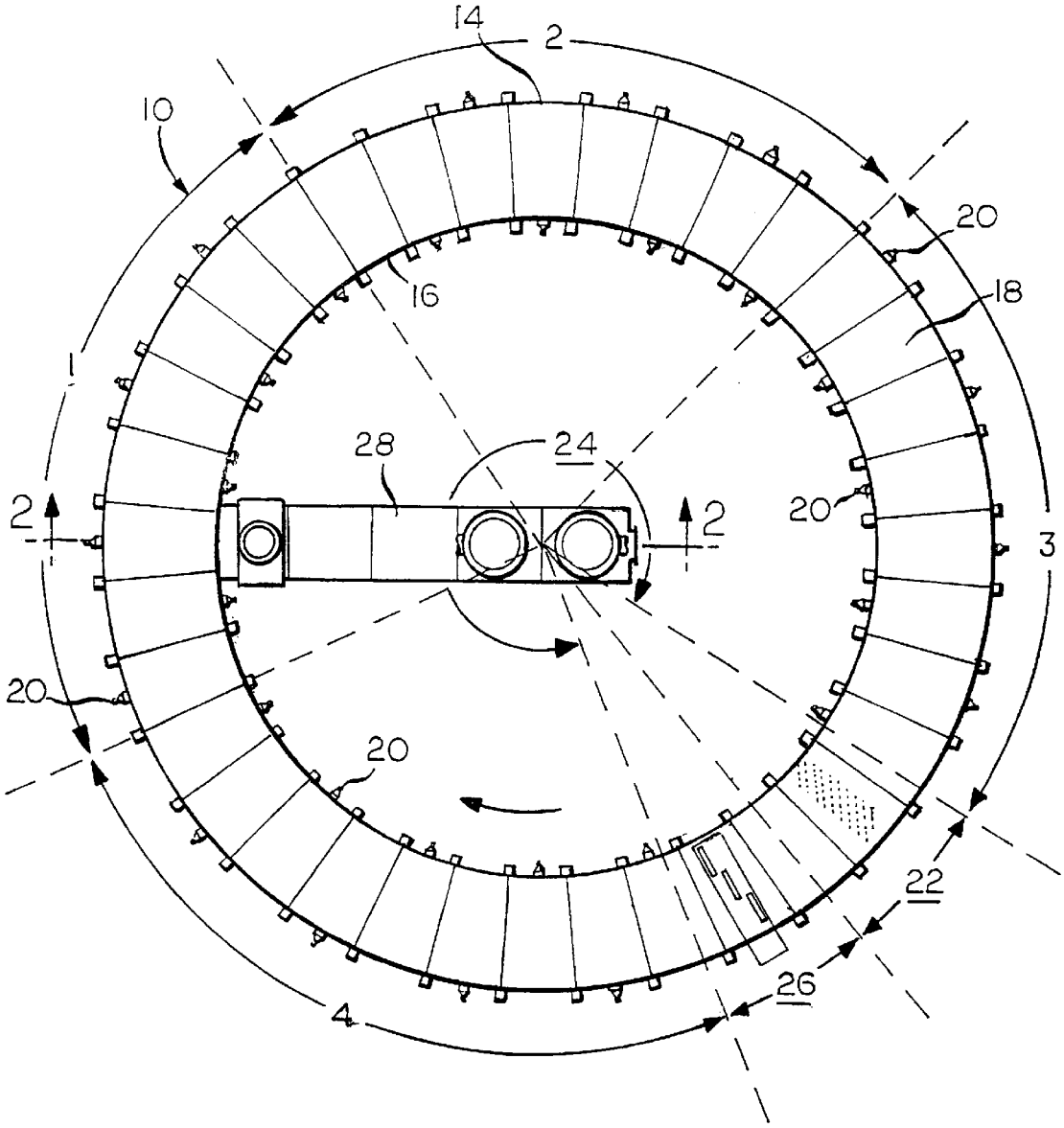
FIG. 1 is a top view of rotary hearth furnace.

Referring to the figures, wherein like reference characters represent like elements, there is shown a rotary hearth furnace 10. It should be noted that for purposes of clarity certain details of construction of the rotary hearth furnace 10 are not provided in view of such details being conventional and well within the skill of the art once the invention is disclosed and explained. For example, burners, blowers, piping and duct work and the like as required for the handling of gaseous and particulate solid materials may be any such known commercially available components with the exception that such components may be modified as necessary by one skilled in the art to be employed in the overall system of the present invention as discussed herein. Reference is made to the Chemical Engineer's Handbook, 7th Edition, McGraw Hill, New York 1984; Kelly, E., G., Introduction To Mineral Processing, John Wiley & Sons, Inc., 1982, and to the chemical engineering industry literature generally for detailed descriptions of the various apparatus and processing structure and conditions.

Referring to the figures, there is shown a rotary hearth furnace 10 including a hearth 12 mounted for rotary movement about its center in the counterclockwise direction. The hearth 12 is disposed in a doughnut shaped enclosure and supported on an array of rollers around its circumference as well known in the art. The enclosure includes an annular inner sidewall 14 and an annular outer sidewall 16. The annular sidewalls 14 and 16 are preferably disposed vertically and are made of a refractory material of a type well known in the art. Positioned between and connecting the uppermost end of the inner and outer sidewalls 14 and 16 is a stationary roof 18. The enclosure is operatively sealed to the hearth 12 by water seals (not shown) as well known in the art.

Suitable burners 20 of a conventional design are positioned in the vertical outer sidewall 14 and/or inner sidewall 16 of the enclosure. The burners 20 may be supplied with a suitable fuel such as oil, pulverized coal and/or gas and combusted with air. The burners 20 are operably fired to provide a controlled temperature within the rotary hearth furnace 10 for reducing the feed material. When processing a feed material containing and releasing coal volatiles, selected burners are utilized as air inlets for the purpose of burning the combustible gases otherwise present within the furnace enclosure. When operating with highly reducing gases in the final quadrant of the processing zone as further described herein, air only is introduced in selected burners to partially burn the combustible gases.

The rotary hearth furnace 10 is typically divided into a plurality of zones including at least a loading zone 28, a preheat zone 26, a process zone 24 and a discharge zone 22. Each zone may be separated from an adjacent zone by a barrier curtain (not shown) which is constructed of an alloy or ceramic fiber suitable to withstand high temperatures and corrosive atmospheres within the zones as is well known in the art. As used herein the term "zone" refers to a separate artificial section of the rotary health furnace wherein the principal activity that is occurring is different from a principal activity occurring in another section of the furnace, e.g., loading, preheating, processing and discharging, etc. Each zone may be further subdivided into sequential quadrants. As used herein the term "quadrant" refers to a separate section of each zone of the furnace. As shown in the figures, the quadrants are of equal size.

In the loading zone 28, a feed material that is to be reduced is distributed onto the rotating hearth 12 of the rotary hearth furnace 10. The feed material may be any suitable material that is to be reduced by heating or that is to be exposed to a process gas in a controlled atmosphere. The feed material may include carbonaceous material, such as coal material, a coal material containing mixture, a petroleum coke re and a petroleum coke containing mixture. The feed material may also include virgin, i.e., untreated or unprocessed, metal oxide concentrates and natural ore fines such as hematite, limonite, magnetite, taconite, siderite, pyrites and chromite and/or metal processing mill waste, electric arc furnace dust, rolling mill scale, or the like, collected as a result of normal metal making operations or a mixture thereof. The feed material may contain volatiles such as a coal material or a coal material containing mixture and the like, or the feed material may be free of volatiles such as a coke material. The feed material may be in particulate, compact or pellet form as well known in the art.

The feed material is preferably uniformly distributed onto the hearth 12 of the rotary hearth furnace 10 by a conventional feeder such as an electric vibratory feeder or a profiled star wheel which extends through an outer sidewall 16 of the furnace a suitable distance above the surface of the hearth. In a preferred embodiment, the feed material is placed generally one layer deep directly on the rotating hearth 12 to facilitate uniform treatment of the feed material and prevent variations in the degree of reaction between highly exposed and less highly exposed feed material.

After the feed material is charged into the loading zone 28, the feed material is transported within the enclosure along the hearth path to the preheat zone 26, then into the process zone 24. The preheat zone 26 operates at a lower temperature than the process zone 24, i.e., 1800 degrees Fahrenheit and 2200 degrees Fahrenheit versus 2300 degrees Fahrenheit and 2600 degrees Fahrenheit, to minimize objectionable thermal transient conditions which might otherwise lead to spalling of the feed material. As shown in FIG. 1, the preheat zone 26 extends from the downstream end of the loading zone 28 to the entry area of the process zone 24.

The process zone 24 is further subdivided into three sequential continguous quadrants identified as 1, 2, and 3. Each quadrant includes an entry area and an exit area. Quadrant 1 extends from the downstream end of the preheat zone 26 to the upstream entry area of quadrant 2, quadrant 2 extends from the exit area of quadrant 1 to the entry area of quadrant 3, quadrant 3 extends from the exit area of quadrant 2 to the upstream end of the discharge zone 22.

In the preheat zone 26, the burners 20 are fired to obtain a desired zone temperature between 1800 degrees Fahrenheit and 2200 degrees Fahrenheit at an air to fuel ratio sufficient to burn the volatile organic matter released from the feed material as the major source of fuel. In the process zone 24, the burners 20 are fired to obtain a desired furnace temperature of between 2300 degrees Fahrenheit and 2600 degrees Fahrenheit and an atmosphere conducive for the reduction of the feed material. The feed material is reduced by subjecting the feed material to radiant heating and the action of combustion gases from the burners 20 and, depending upon the feed material, to process gases evolved from the processing of the feed material during travel around the hearth path. Air may also be introduced as needed to the process zone 24 of the furnace to combust with any excess carbon monoxide and hydrogen from the combustion process to form carbon dioxide and water vapor and release heat to maintain a desired hearth temperature for the treatment of the feed material in the process zone.

After the feed material is reduced in the process zone 24, the reduced feed material is removed from the rotating hearth in the discharge zone 22. For example, the reduced feed material may be discharged from the discharge zone 22 by a helical screw disposed across and spaced above the hearth. The reduced feed material may then be discharged to a soaking pit and the like for further processing as well known in the art.

In an alternative embodiment, the rotary hearth furnace 10 may also include a warming zone (not shown). The warming zone of the rotary hearth furnace 10 is located immediately before the loading zone for the introduction of the feed material. The warming zone, void of feed material, may be heated to a desired temperature prior to loading of the feed material. It will be appreciated that warming of the hearth void of feed material immediately prior to charging of the feed material allows for the warming of the entire upper surface of the hearth furnace and for radiant heating of the subsequently introduced feed material from the top and for conductive and radiant heating of the feed material from the bottom. It will be appreciated that dedicated warming of a zone of the rotary hearth furnace void of feed material allows the furnace to warm the rotating hearth and achieve a constant loading zone temperature as opposed to a rotary hearth furnace that experiences a cooling effect caused by the continuous charging of cold feed material to the rotating hearth of the furnace.

The roof 18 of the rotary hearth furnace 10 includes a flue 30 positioned within the area of the process zone 24 of the furnace between the preheat zone 26 and the discharge zone 22. By placing the flue 30 within the process zone 24, the feed material, process gas and combustion gases flow within the preheat zone 26 and are combined with oxygen from combustion air and burn releasing heat within the preheat zone 26 and allow process gas and combustion gases to flow from the discharge zone 22 and combine with oxygen from air and/or oxygen enriched air and burn thereby also releasing heat within the furnace 10.

The flue 30 may be positioned anywhere between the exit area of the preheat zone 26 and the entry area of quadrant 3 of the process zone. In a preferred embodiment of the invention, the rotary hearth furnace 10 includes a flue 30 positioned at approximately the exit area of the preheat zone 26 or the exit area of quadrant 2 of the process zone. It will be appreciated that by positioning the flue 30 at approximately the exit area of the preheat zone 26, the loading zone and the discharge zone of the furnace may be maintained at a pressure equal to atmospheric pressure to preclude furnace gases from escaping through the loading or discharge mechanism in a positive pressure situation, and to preclude unwanted air from entering the furnace in a negative pressure situation.

Figure 2:
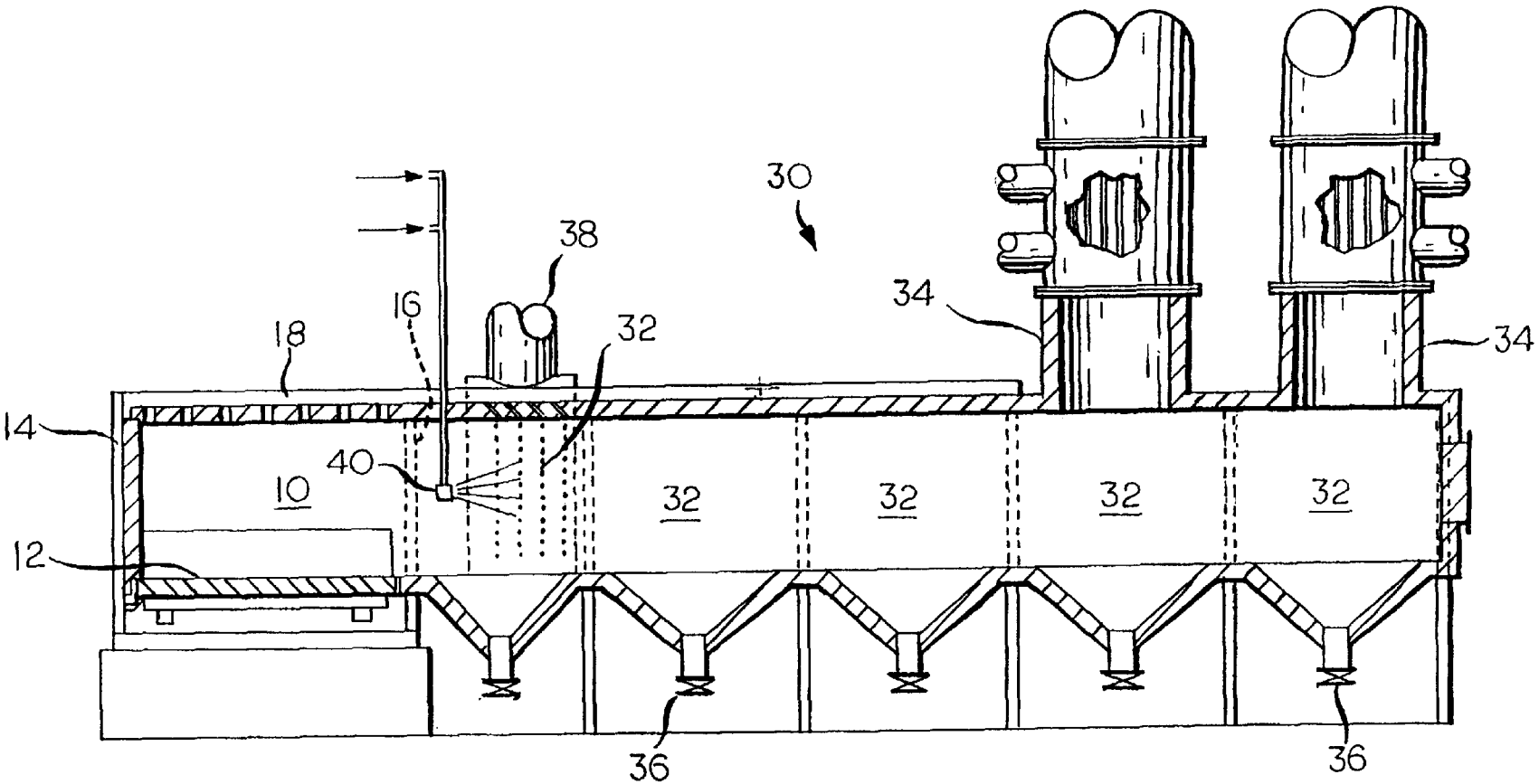
FIG. 2 is a sectional view taken along line 2—2 of FIG. 1.

As shown in FIG. 2, the flue 30 includes a series of interconnected horizontally extending afterburner chambers 32 and one or more vertically extending stacks 34. The bottom of the chambers 32 are conical shaped and puts as drop out chambers to and as a collection area as further described below. Operatively connected to the bottom of each chamber 32 is a dust removal valve 36 of a type well known in the art. The dust removal valve 36 facilitates access and removal of dust and particulate matter that falls out and is collected in the afterburner chambers 32.

It will be appreciated that the hot exhaust stack gases within the flue 30 leave the rotary hearth furnace 10 containing waste sensible energy and chemical energy. The waste sensible energy is in the form of heat and the chemical energy in the form of organic volatiles, carbon monoxide and hydrogen. The stack gases may also carry particulates consisting of fine metallic oxides and/or carbonaceous material. In order to achieve acceptable emission standards for the stack gases from the rotary hearth furnace 10, combustion air and/or oxygen is introduced to the afterburner chambers 32 via an air pipe 38 to combust with the organic volatiles, other combustible gases and carbonaceous particulates from the rotary hearth furnace. The unburned particles within the stack gases then settle out within the collection area of the downstream after burner chambers 32 for removal through dust removal valves 36.

It will be appreciated that the gases leave the rotary hearth furnace 10 at temperatures ranging from 1800 degrees Fahrenheit to 2350 degrees Fahrenheit, and rise to temperatures in excess of 2500 degrees Fahrenheit when combined with combustion air and/or oxygen. Temperatures in excess of 2500 degrees Fahrenheit are favorable to the formation of nitrogen oxides. Accordingly, it is necessary to control the combustion temperature within the afterburner chambers 32 to facilitate low particulate carryover, acceptable hydrocarbon emissions, acceptable carbon monoxide emissions, and acceptable low NOx emissions. The afterburner chamber 32 temperature is controlled for the after burning process to less than about 1800degrees Fahrenheit to prevent oxidation of nitrogen to form nitrogen oxides. The temperature in the afterburner chamber 32 is controlled by a water spray quench. The water spray quench injects water droplets into the stream of combustion air and/or oxygen by atomizing the water droplets and cooling the temperature within the afterburner chamber 32 and the flue 30. In a preferred embodiment, water droplets are injected via a plurality of fluid nozzles 40 within the flue 30. The fluid nozzles 40 may be most any suitable nozzle such as Flo Max air atomizing nozzles from Spraying Systems Co.

It will be appreciated that in the case of the operation of a typical rotary hearth furnace, combustion gases from the burners 20 and gases resulting from processing of the feed material are exhausted near the loading zone 26 of the furnace to provide maximum exposure of the feed material to the exhaust gases and the process gases. However, it has been found that a significant portion of exhaust gases and combustible rich process gases produced in a typical rotary hearth furnace tend to flow directly to the flue and short-circuit the reduction zone.

Various aspects of the present invention will be further clarified by a consideration of the following examples, which are intended to be purely exemplary of the invention.

EXAMPLES

The rotary hearth furnace is subdivided into two zones, a preheat zone 26 and process zone 24. The process zone 24 of the rotary hearth furnace is subdivided into three equal quadrants (1, 2, and 3) as shown in FIG. 1 to evaluate the effect of the position of the flue on stack gas flow and energy consumption. Stack gas flow is the measured flow rate of products of combustion and process gas evolved from the furnace. Energy consumption is the measured energy consumed in reducing a feed material.

In the examples it is assumed that about 105,032 lbs/hr. of a feed material comprising about 79 weight percent agglomerated low silica hematite ore and about 21 weight percent low volatile bituminous coal is reduced in a rotary hearth furnace. The rotary hearth furnace is maintained at a constant operating temperature of about 2350 degrees Fahrenheit and an operating $CO/CO_2$ ratio of between about 2–3 to maintain a reducing atmosphere within quadrant 3 of the furnace. The combustion air for delivery to all quadrants is preheated to about 1200 degrees Fahrenheit prior to introduction into the furnace.

The quantity of natural gas fuel supplied to the rotary hearth furnace to maintain a constant furnace temperature of 2350 degrees Fahrenheit is determined as a function of the position of the flue when located at the exit area of quadrants 1, 2, and 3 the exit area of the preheat zone 26 and the exit area of the Charging Zone. The results are provided in Table 2.

TABLE 2

| Flue Position | Natural Gas Flow Rate (lbs/hr) |
|---|---|
| Quadrant 3 | 12,535 |
| Quadrant 2 | 11,614 |
| Quadrant 1 | 9,006 |
| Preheat Zone 26 | 7,035 |
| Downstream of Charging Zone | 11,300 |

As shown in Table 2, the largest requirement of natural gas will occur when the flue is positioned at the exit area of quadrant 3. Furthermore, the smallest requirement of natural gas will occur when the flue is positioned at the exit area of the preheat zone 26.

The volume of stack gases from the rotary hearth furnace is determined as a function of the position of the flue at the exit area of quadrants 3, 2, 1 and preheat zone 26, and immediately downstream of the Charging Zone. The results are provided below in Tables 3–5.

TABLE 3

| | Furnace Exhaust (lbs/hr) | | | | | | |
|---|---|---|---|---|---|---|---|
| Flue Position | $H_2O$ | $H_2$ | $N_2$ | CO | $CO_2$ | Coal Volatile | Total |
| Quadrant 3 | 33,968 | 1,085 | 149,261 | 36,504 | 30,379 | 0 | 251,197 |
| Quadrant 2 | 33,176 | 919 | 145,375 | 34,150 | 31,550 | 0 | 245,170 |
| Quadrant 1 | 32,493 | 327 | 135,964 | 29,139 | 32,269 | 0 | 230,192 |
| Preheat zone 26 | 29,079 | 167 | 124,275 | 23,352 | 35,957 | 0 | 212,860 |
| Downstream Discharge Zone | 24,548 | 369 | 137,022 | 26,213 | 41,823 | 3,903 | 233,878 |

TABLE 4

| | Afterburner Air (lbs/hr) | | |
|---|---|---|---|
| Flue Position | Combustion | Cooling | Total AFB Air |
| Quadrant 3 | 127,730 | 347,405 | 475,135 |
| Quadrant 2 | 116,824 | 318,798 | 435,622 |
| Quadrant 1 | 83,905 | 253,870 | 337,775 |
| Preheat zone 26 | 85,033 | 163,593 | 248,526 |
| Downstream Discharge Zone | 122,358 | 338,749 | 461,107 |

TABLE 5

| Flue Position | Gas to PAS (lbs/hr) | Cooling Water (lbs/hr) | Total Stack Gas (lbs/hr) |
|---|---|---|---|
| Quadrant 3 | 726,332 | 219,422 | 945,754 |
| Quadrant 2 | 680,792 | 206,368 | 887,160 |
| Quadrant 1 | 567,967 | 173,140 | 741,107 |
| Preheat zone 26 | 461,386 | 141,481 | 602,867 |
| Downstream Discharge Zone | 694,985 | 203,993 | 898,978 |

As shown in Table 5, the largest flow rate of stack gas will occur when the flue is positioned at the exit area of quadrant 3. Furthermore, the smallest flow rate of stack gas will occur when the flue is positioned at the exit area of the preheat zone 26.

Coal volatiles are released in the preheat zone 26 of the furnace with little appreciable metalization and may be burned with a low $CO/CO_2$ ratio. In quadrants 1 and 2, the $CO/CO_2$ ratio becomes more important to limit re-oxidation of the reduced iron in the feed material. In quadrant 3, the $CO/CO_2$ ratio must be between about 1.5–3.5 to suppress re-oxidation of the reduced iron. The CO and other reducing gases produced in quadrant 3 are burned in quadrants 1 and 2 to provide energy to the reduction process. Air is added to the furnace to combust with CO and $H_2$ and to reduce the volume of stack gas.

In yet another embodiment of the process of the present invention, the preheated combustion air for quadrant 3 may be enriched with 95% purity oxygen. The oxygen content is typically increased from about 21% to as much as 30%. This increase improves the available heat from a nominal 218 to 265 BTU/$ft^3$ fuel.

The patents and documents referenced herein are hereby incorporated by reference.

Having described presently preferred embodiments of the invention, it is to be understood that it may be otherwise embodied within the scope of the appended claims.

What is claimed is:

1. A rotary hearth furnace for reducing a feed material comprising:

a rotating hearth disposed in an enclosure and mounted for rotary movement, the enclosure including an annular inner wall, an annular outer wall and a roof, the enclosure operatively sealed to the hearth and divided into a plurality of zones including at least a loading zone, an preheat zone, a process zone and a discharge zone, the process zone further divided into three sequential quadrants (1, 2, and 3), each quadrant having an entry area and an exit area;

said preheat zone operating in a temperature range of from 1800 degrees Fahrenheit to 2200 degrees Fahrenheit, said process zone operating in a temperature range of from 2300 degrees Fahrenheit to 2600 degrees Fahrenheit, a plurality of burners positioned in at least the outer wall or the inner wall of the enclosure to provide a controlled temperature within the rotary hearth furnace; and a flue for the furnace enclosure to exhaust combustion gases from the rotary hearth furnace, the flue positioned between the exit area of the preheat zone and the entry area of quadrant 1 of the process zone, said flue including at least one afterburner chamber for further combustion of the exhaust combustion gases and collection of particulates from the rotary hearth furnace, said after burner chamber including a water spray quench to reduce the combustion temperature for NOx control.

2. The rotary hearth furnace of claim 1 wherein the feed material is selected from virgin metal oxide concentrates, natural metal ore fines, metal mill waste, electric arc furnace dust, rolling mill scale and mixtures thereof.

3. The rotary hearth furnace of claim 2 wherein the feed material further comprises carbonaceous material.

4. The rotary hearth furnace of claim 2 wherein the feed material is reduced by subjecting the feed material to radiant heating and the action of combustion gases from the burners.

5. The rotary hearth furnace of claim 3 wherein the carbonaceous material is selected from a coal material, a coal material containing mixture, a petroleum coke and a petroleum coke containing mixture.

6. The rotary hearth furnace of claim 5 wherein the feed material is reduced by subjecting the feed material to radiant heating and the action of combustion gases from the burners and process gases evolved from the volatiles.

7. The rotary hearth furnace of claim 1 wherein the feed material is uniformiy distributed onto the hearth about one layer deep to facilitate uniform treatment of the feed material.

8. The rotary hearth furnace of claim 1 wherein the burners include air inlets to introduce air to combust with combustible gases within the enclosure.

9. The rotary hearth furnace of claim 1 wherein the flue of the rotary hearth furnace is positioned at about the exit area of quadrant 1.

10. The rotary hearth furnace of claim 1 wherein the flue of the rotary hearth furnace is positioned at about the exit area of the preheat zone.

11. A process of reducing a feed material in a rotary hearth furnace, the rotary hearth furnace including a rotating hearth disposed in an enclosure and mounted for rotary movement, the enclosure including an annular inner wall, an annular outer wall and a roof, the enclosure operatively sealed to the hearth and divided into a plurality of zones including at least a loading zone, a preheat zone, a process zone and a discharge zone, the process zone further divided into three sequential quadrants (1, 2, and 3), each quadrant having an entry area and an exit area, the process comprising the steps of:

charging the feed material into the loading zone of the rotary hearth furnace;

transporting the feed material from the loading zone through the process zone to the discharge zone along a hearth path within the enclosure;

firing the burners to obtain a desired furnace temperature;

reducing the feed material within the rotary hearth furnace; and removing the reduced feed material from the furnace, wherein combustion gases are exhausted from the burners through a flue operatively positioned between the exit area of the preheat zone and the entry area of quadrant 2 of the process zone wherein the flue includes at least one afterburner chamber for further combustion of the exhaust combustion gases and collection of particulates from the rotary hearth furnace, and reducing the combustion temperature within the afterburner chamber by spraying a water spray quench within the afterburner chamber.

12. The process of claim 11 wherein the feed material is reduced by subjecting the feed material to radiant heating and the action of combustion gases from the burners.

13. The process of claim 11 further comprising the steps of introducing combustion air to the preheat zone of the furnace to combust with volatile matter contained in the feed material and any excess carbon monoxide and hydrogen from the combustion process to form carbon dioxide and release heat to maintain a desired hearth temperature for the treatment of the feed material.

14. The process of claim 11 wherein only combustion air is introduced through the burners in quadrant 1 of the process zone to partially burn the combustible gases.

15. The process of claim 14 wherein the combustion air is preheated to about 800° F. to 1400° F.

16. The process of claim 15 wherein the combustion air is preheated to about 1200° F.

17. The process of claim 16 wherein the preheated combustion air for quadrant 3 is enriched with oxygen.

18. The process of claim 17 further comprising the step of enriching the preheated combustion air with from about 21%–30% oxygen.

19. The process of claim 17 wherein the flue is positioned at about the exit area of quadrant 1.

20. The process of claim 17 wherein the flue is positioned at about the exit area of preheat zone.

21. The process of claim 14 wherein the combustion air is enriched with oxygen.

22. The process of claim 14 wherein the combustion air is replaced by oxygen.

23. The process of claim 11 wherein the feed material is selected from virgin metal oxide concentrates, natural metal ore fines, metal mill waste, electric arc furnace dust, rolling mill scale, coal material, coal material containing mixture and mixtures thereof.

* * * * *